US010994162B2

(12) United States Patent
Murray et al.

(10) Patent No.: US 10,994,162 B2
(45) Date of Patent: May 4, 2021

(54) STOVETOP FIRE SUPPRESSOR INITIATOR DEVICE AND METHOD

(71) Applicant: WILLIAMSRDM, INC., Fort Worth, TX (US)

(72) Inventors: Donald W Murray, Arlington, TX (US); Richard M Anthony, River Oaks, TX (US)

(73) Assignee: WilliamsRDM, Inc., Fort Worth, TX (US)

( * ) Notice: Subject to any disclaimer, the term of this patent is extended or adjusted under 35 U.S.C. 154(b) by 426 days.

(21) Appl. No.: 15/421,006

(22) Filed: Jan. 31, 2017

(65) Prior Publication Data

US 2018/0214722 A1 Aug. 2, 2018

Related U.S. Application Data

(62) Division of application No. 13/965,146, filed on Aug. 12, 2013, now Pat. No. 9,597,534.

(51) Int. Cl.

| | |
|---|---|
| ***A62C 3/00*** | (2006.01) |
| ***A62C 37/12*** | (2006.01) |
| ***A62C 35/10*** | (2006.01) |

(52) U.S. Cl.

CPC ..... *A62C 3/006* (2013.01); *A62C 35/10* (2013.01); *A62C 37/12* (2013.01)

(58) Field of Classification Search

CPC ..... A62C 3/006; A62C 35/10; A62C 37/12

See application file for complete search history.

(56) References Cited

U.S. PATENT DOCUMENTS

| | | | | |
|---|---|---|---|---|
| 5,131,679 | A * | 7/1992 | Novak | B60R 21/2644 102/530 |
| 5,899,278 | A * | 5/1999 | Mikulec | A62C 3/006 169/65 |
| 9,597,534 | B1 * | 3/2017 | Murray | A62C 3/006 |
| 2008/0149562 | A1 * | 6/2008 | Tarr | B01D 61/10 210/637 |

* cited by examiner

*Primary Examiner* — John C Hong

(74) *Attorney, Agent, or Firm* — Foley & Lardner LLP

(57) ABSTRACT

An initiator with fuse device for an automatic self-contained fire suppressor and method are provided herein. Stovetop fires are a well-known residential and commercial hazard. An initiator with fuse device provides a reliable activation of an automatic stovetop fire suppressor. A device and method which provides a secure and robust attachment of an initiator to a fire suppressor, while reducing required component parts, manufacturing time, and labor, is provided herein. An initiator cup with integral cylindrical extension affords a thermoform attachment of the cup to the fire suppressor container while providing a secure mechanical attachment of the fuse to the initiator cup.

11 Claims, 5 Drawing Sheets

605

STOVETOP FIRE SUPPRESSOR INITIATOR DEVICE AND METHOD

CROSS REFERENCE TO RELATED APPLICATIONS

This application is a divisional application of and claims priority to U.S. patent application Ser. No. 13/965,146 filed 12 Aug. 2013, the entire contents of which are incorporated herein by reference.

FIELD OF THE INVENTION

The present invention relates to a device and method of fire suppression, and more particularly to an initiator device and method thereof for an automatic stovetop fire suppressor.

BACKGROUND OF THE INVENTION

Stovetop fires are a well-known residential and commercial hazard. An unattended stovetop fire, for example a grease fire, can cause damage to nearby appliances and cabinets. Worse, stovetop fires can lead to structural damage or injury. Because the propensity for stovetop fires is so pervasive, an efficient means of automatic fire suppression is desired. Even if a stovetop fire is attended, an automatic extinguishing method may be more effective, safe, and expedient compared to manual means.

A number of conventional automatic stovetop fire extinguishers, which mount near a stovetop surface, are available. These include: U.S. Pat. No. 6,276,461 to Stager; U.S. Pat. No. 6,105,677 to Stager; U.S. Pat. No. 5,899,278 to Mikulec; U.S. Pat. No. 7,472,758 to Stevens and Weintraub; U.S. Pat. No. 7,610,966 to Weintraub et al; U.S. Pat. No. 5,518,075 to Williams; and U.S. Pat. No. 3,884,307 to Williams. The array of conventional fire suppression systems vary from activation by melting of a fusible pin (Stager'461), to melting a solder fusible plug (Stager'677), to burning of a fuse (Williams'307, Stevens'758), or to activating via a glass bulb fuse mechanism (Mikulec).

Conventional fire extinguishers, STOVETOP FIRE-STOP® fire suppressors (Williams-Pyro, Inc., Fort Worth, Tex., USA), which are particularly well suited to a stovetop environment, include a container of an extinguishing or fire suppressing agent mounted to a vent hood above the stovetop and activated by a fuse. An example of such an extinguisher is shown in FIG. 1A. FIG. 1A is a partial cross-sectional view of a conventional fire suppressor, revealing the initiator 101 within the container 23 of the fire suppressor 100. Container 23 has a top wall 23B and a side wall 23C, while the bottom of the container is a lid 27, which comprises a lip 23A. Shown exiting from the lid 27 is fuse 61 which feeds into an initiator 101 in the fire suppressor 100. A fire on the stovetop ignites the fuse 61, which in turn detonates an initiator 101. The igniter opens the bottom 27 of the container 23, thereby allowing the disbursement of the extinguishing agent 29 onto the fire and the stovetop. The conventional fuse and initiator assembly is effective at automatically activating a fire suppressor under a stovetop fire condition. Still referring to FIG. 1A, also shown on an outer side of lid 27 is a terminal 93. A magnet 31 and magnet housing 33 provide a vent hood mount for the conventional stovetop fire suppressor.

A conventional initiator, which may be found in a conventional fire-suppressor such as that shown in FIG. 1A, is shown in greater detail in FIG. 1B and is described below with reference to FIG. 1B. The conventional fuse and initiator assembly is effective at activating a fire suppressor in the presence of a stovetop fire. Manufacture and assembly of a conventional fuse and initiator assembly is described below with reference to FIG. 2. As in many conventional manufacturing processes and as with many products, it would be desirable to improve the efficiency of the manufacturing process of the initiator and to improve the initiator device if possible. It may also be desirable to have a fuse that is activated only by a flame and not by heat or electrical charge.

SUMMARY OF THE INVENTION

The present invention addresses some of the issues presented above by providing a new initiator cup in an automatic stovetop fire suppressor. Embodiments of the present invention may have any of the aspects below.

One aspect of the present invention is to provide an efficient flame activation apparatus for a stovetop fire suppressor.

Another aspect of the present invention is to improve the manufacturing efficiency of an initiator and to assemble a stovetop fire extinguisher.

Another aspect of the present invention is to reduce the number of processing steps to manufacture an initiator and to assemble a stovetop fire extinguisher.

Another aspect of the present invention is to create an initiator with fewer parts than conventional initiators.

Another aspect of the present invention is to create an initiator at a decreased cost.

Another aspect of the present invention is to decrease assembly process time to create an initiator for a fire suppressor.

Yet another aspect of the present invention is to decrease assembly labor to build an initiator.

Yet another aspect of the present invention is to provide improved fuse retention in an initiator for an automated stovetop fire extinguisher.

Yet another aspect of the present invention is to provide improved fuse retention in an initiator for an automated stovetop fire suppressor using a rough fuse outer surface.

Yet another aspect of the present invention is to provide improved fuse retention in an initiator for an automated stovetop fire suppressor using a smaller inner diameter of the fuse passage in the cup as compared to an outer diameter of the fuse.

Yet another aspect of the present invention is to mechanically seal the fire extinguishing container about the fuse.

Yet another aspect of the present invention is that the attaching mechanism securing the initiator cup to the container lid is integrated to the cup itself.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Same reference numbers across figures refer to like elements for ease of reference. Reference numbers may also be unique to a respective figure or embodiment.

Figure 1A:
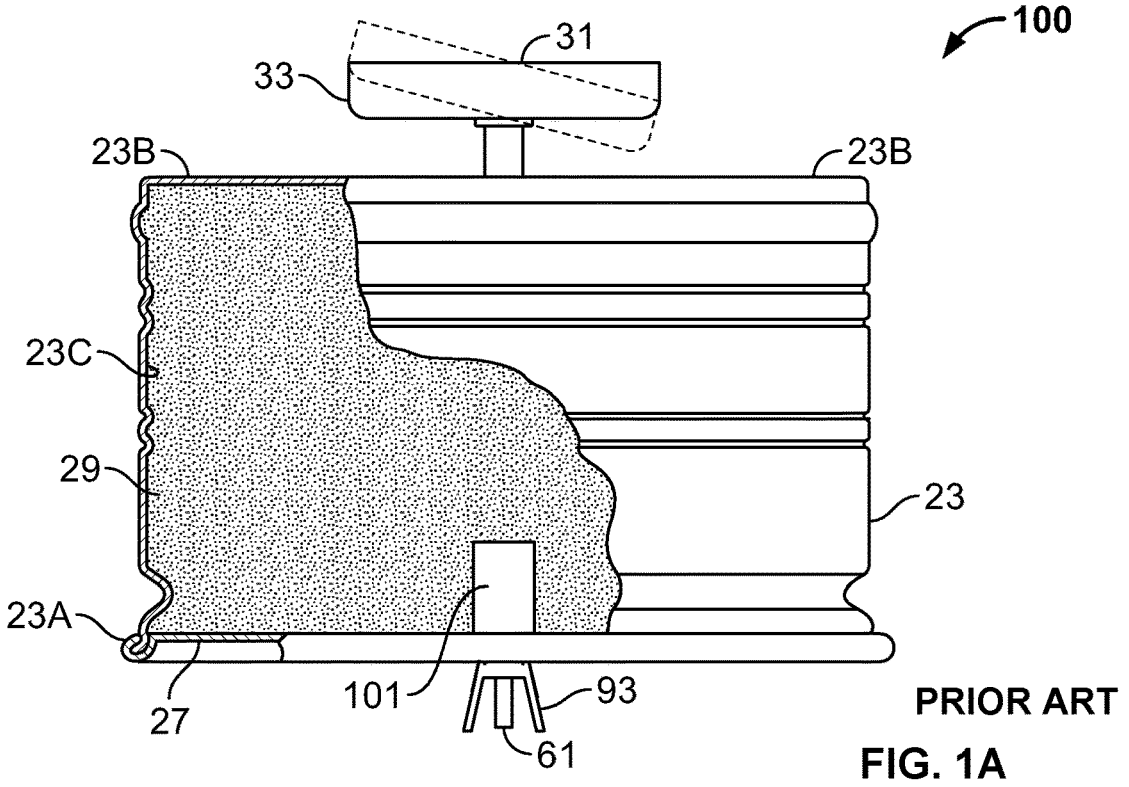
PRIOR ART FIG. 1A
FIG. 1A is a partial cross-sectional view of a conventional fire suppressor, revealing the initiator within the fire suppression container
Figure 1B:
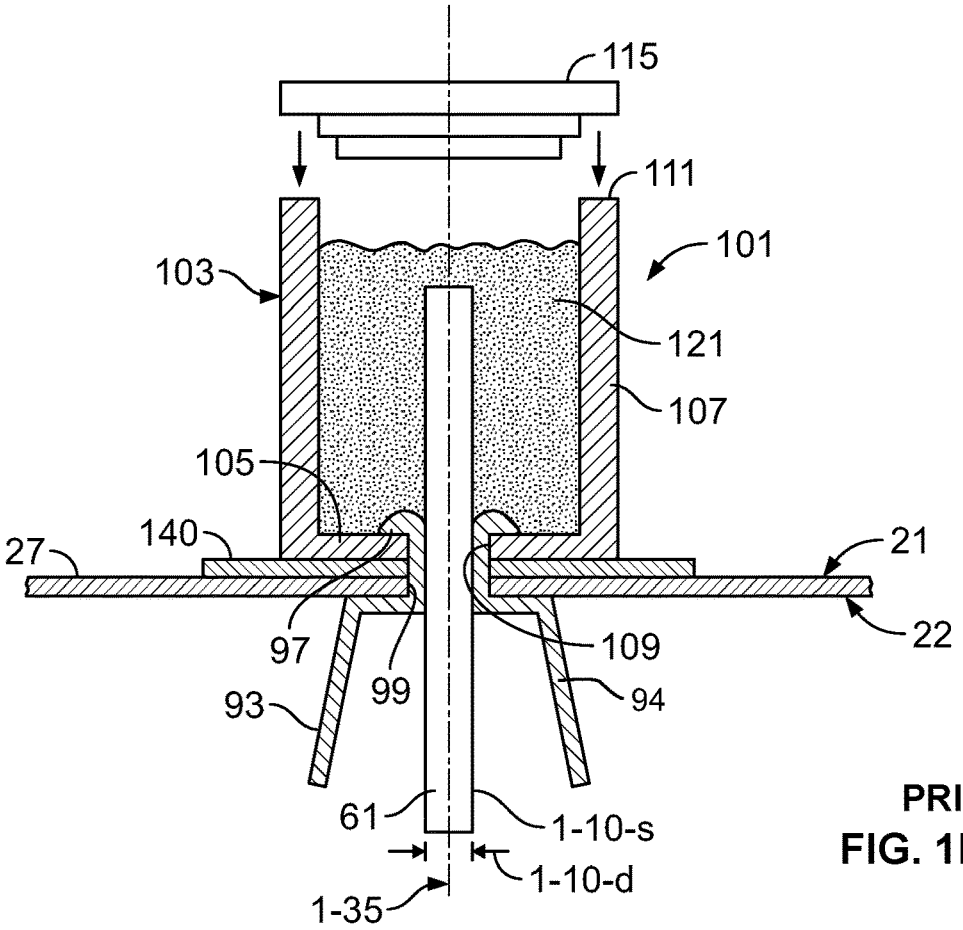
PRIOR ART FIG. 1B
FIG. 1B shows a cross section of the conventional initiator with fuse in greater detail.

Briefly, FIG. 1A is a partial cross-sectional view of a conventional fire suppressor, revealing an initiator within the fire suppression container and FIG. 1B shows a cross section of a conventional initiator with fuse in greater detail. Referring to FIG. 1A, a fire suppressor 100 has a container 23 which has a top wall 23B, side wall 23C and a bottom lid 27. Housed within the container are extinguishing, fire suppressing, matter 29 and an initiator 101. A fuse 61 feeds into the initiator. Surrounding the fuse 61 is a terminal 93. Turning to FIG. 1B, the initiator 101 has a cup 103, a cap 115, and explosive or explosive substitute material 121 housed in the cup 103. The cup 103 a side wall 107 and a center hole 109 through its bottom wall 105. The cup bottom wall 105 sits directly atop fiber washer 140. The fiber washer is not shown in FIG. 1A. Referring again to FIG. 1B, the terminal 93 comprises a lower shield end 94 and a top rivet end 97. The terminal 93 secures the cup 103 to the lid 27. The cap 115 is secured to the top 111 of the side wall 107. When assembled the fuse 61 extends out an outer side 22 of the lid 27 while the felt washer 140 is sandwiched between the bottom wall 105 of the cup 103 and the inner side 21 of the lid 27. The terminal 93 extends from an inner side of the cup 103 at its rivet end 97 through the cup hole 109, the washer 140 and a lid hole 99, which are all aligned along a device center 1-35. Fuse 61 has a surface 1-10-*s* and a diameter 1-10-*d* and will be further described below relative to FIGS. 3A and 3B.

Figure 2:
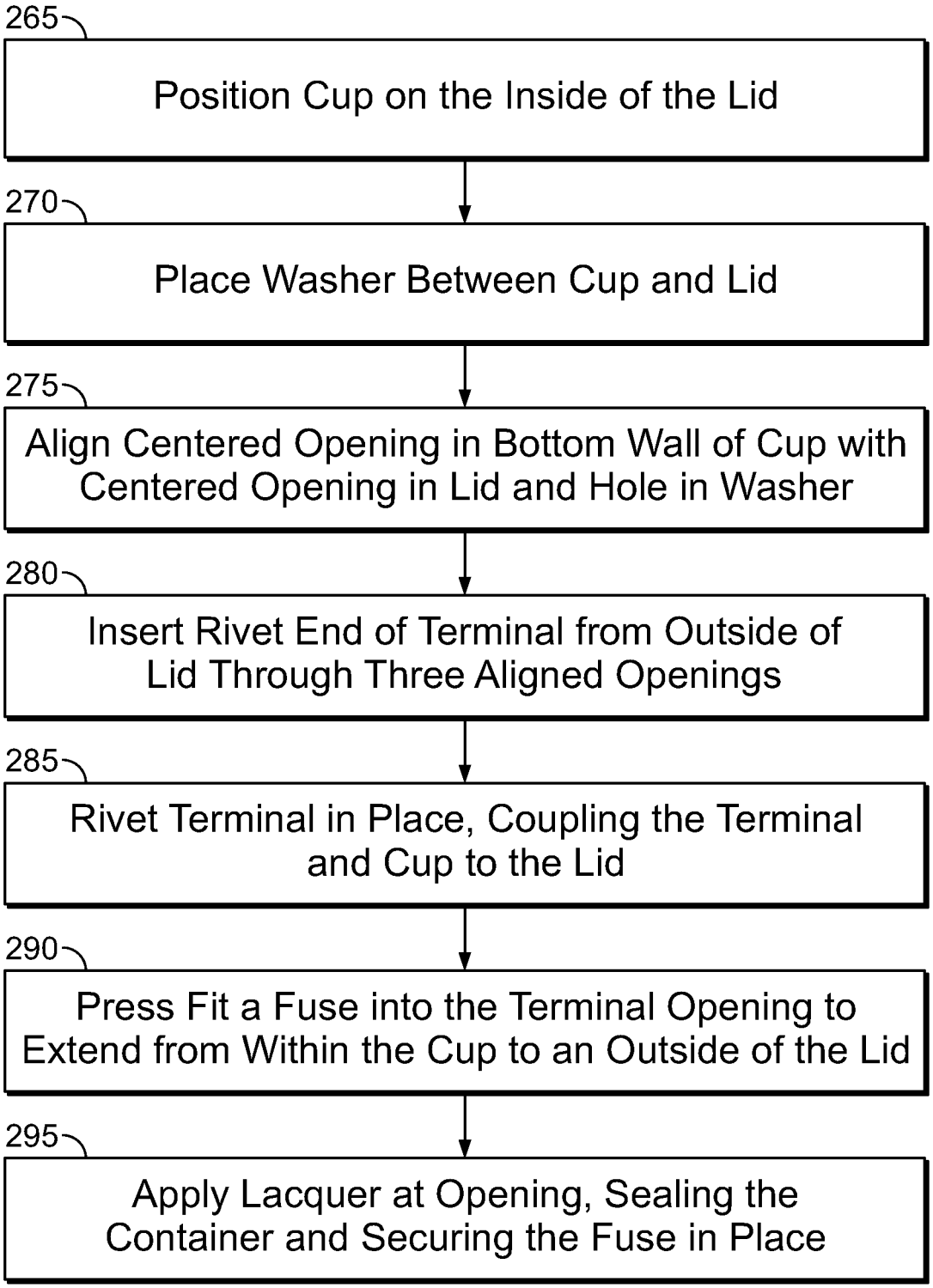
PRIOR ART FIG. 2
FIG. 2 shows a conventional method of making an initiator for an automatic stovetop fire extinguisher container.

FIG. 2 shows a conventional method of making an initiator for an automatic stovetop fire extinguisher container. Referring to FIG. 2, position an initiator cup on the inner side of the container lid 265. Place a felt washer between the cup and the lid 270. Align the respective centered openings of the bottom wall of the cup, the washer, and the lid 275. Insert the rivet end of the terminal from outside the lid through the three aligned openings 280. Rivet the terminal in place, coupling the terminal and cup to the lid 285. Press fit a fuse into the terminal opening to extend from within the cup to an outside of the lid 290. Apply lacquer at terminal opening and fuse interface, sealing the fire suppressor container and securing the fuse in place 295. The cup may then be loaded with a predetermined quantity of combustible material 121. The combustible material could be loaded into the cup 103 before the fuse 61 is inserted. Securing of cap 115 to the top 111 of the cup 103 completes a conventional process.

Figure 3A:
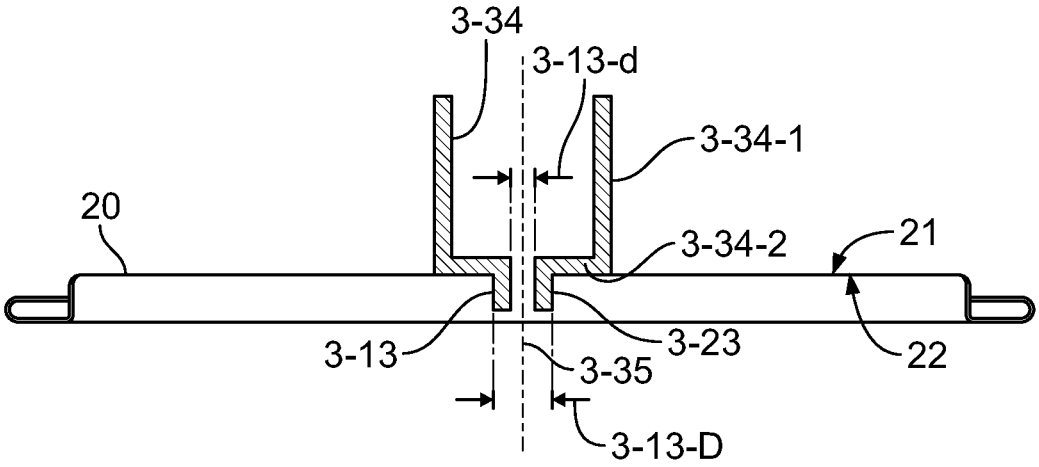
FIG. 3A shows a cross section of an initiator cup and fire suppression container lid, in accordance with an exemplary embodiment of the present invention.

FIG. 3A shows a cross section of an initiator cup and a fire suppression container lid, in accordance with an exemplary embodiment of the present invention. Container lid 20 has an inner side 21 and an outer side 22. An initiator cup 3-34 has a side wall 3-34-1 and a base wall 3-34-2. The cup 3-34 has a centered 3-35 hole in a base wall 3-34-2. A cylindrical extension, or extended base, 3-23 is integrated with the base 3-34-2 and has an inner diameter of 3-13-*d*. The outer diameter 3-13-D of the cylindrical extension fits into a centered 3-35 hole in the lid 20, where the centered lid hole has nearly the same 3-13-D diameter as that of outer diameter of the cylindrical extension 3-23. In FIG. 3A, the cylindrical extension 3-23 is shown in its extended form 3-13.

Figure 3B:
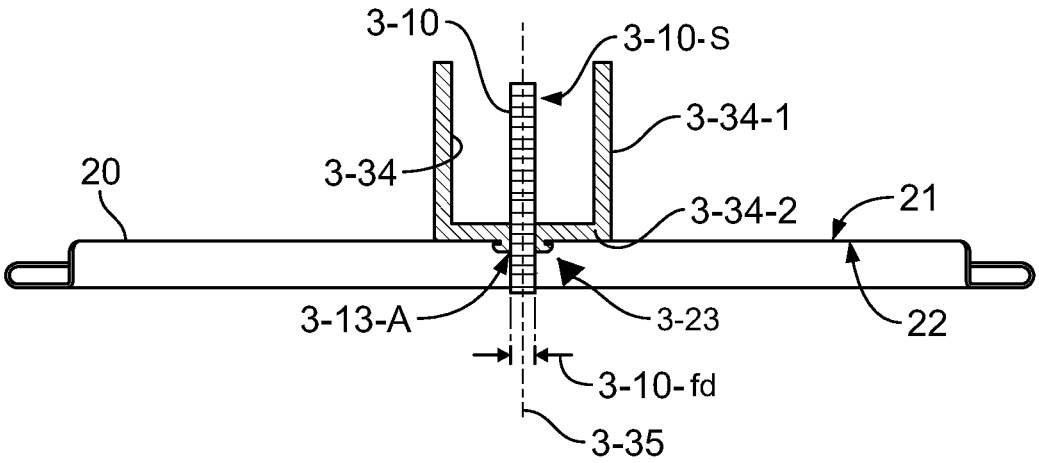
FIG. 3B shows a cross section of an initiator cup with fuse attached to a fire suppression container lid, in accordance with an exemplary embodiment of the present invention.

FIG. 3B shows a cross section of an initiator cup 3-34 with fuse 3-10 attached to a fire suppression container lid 20, in accordance with an exemplary embodiment of the present invention. The cup 3-34, cylindrical extension 3-23, and lid 20 retain centered 3-35 holes. The cup 3-34 is shown with its side wall 3-34-1. The cup's base 3-34-2 is juxtaposition an inner side 21 of the lid 20. The cylindrical extension 3-23 has been formed into its attachment form 3-13-A. An outer edge of attached cylindrical extension 3-13-A now extends past the diameter of the lid 20 hole, where lid hole diameter is approximately that of the outer cylindrical extension 3-10-D, shown in FIG. 3A. Referring again to FIG. 3B, in accordance with an exemplary embodiment, fuse 3-10 has a rough surface 3-10-*s* and an outer diameter 3-10-*fd*. In accordance with exemplary embodiments of the present invention, the initiator cup 3-34 with its cylindrical extension 3-23 is one injection molded piece.

Figure 4:
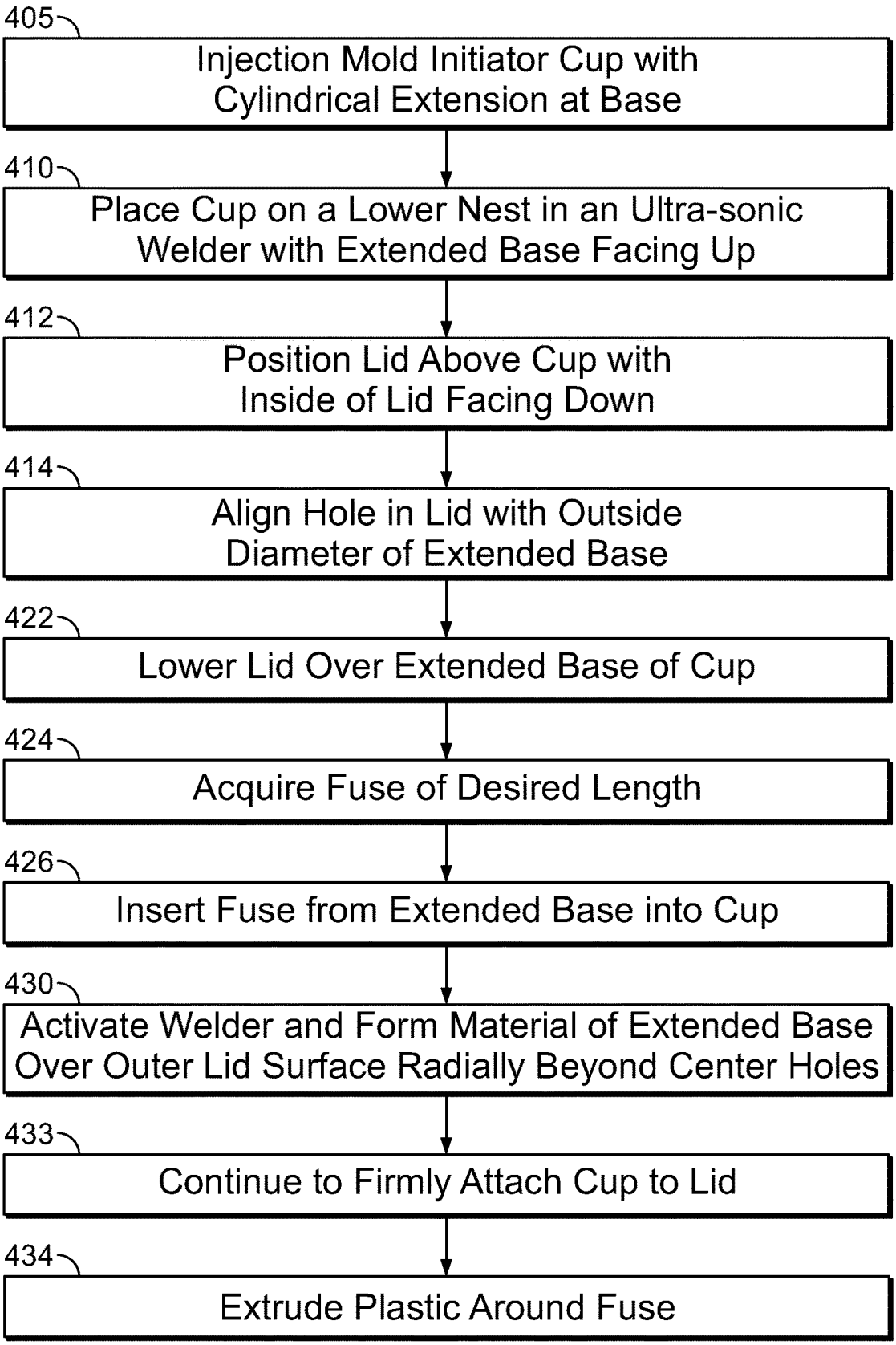
FIG. 4 shows an exemplary method of making an initiator with fuse for an automatic stovetop fire suppressor container, in accordance with an exemplary embodiment of the present invention.

FIG. 4 shows an exemplary method of making an initiator with fuse for an automatic stovetop fire suppressor container, in accordance with an exemplary embodiment of the present invention. Referring to FIG. 4, injection mold initiator cup with its cylindrical base/extension 405. Place cup on a lower nest in an ultra-sonic welder with the extended base/cylindrical extension facing up 410. Position the container lid above the cup with the inside of the lid facing down 412. Align the centered hole in the lid with the outside diameter of the cylindrical extension 414. Lower the lid over the extended base, cylindrical extension, of the cup 422. Acquire fuse of desired length 424. Insert fuse from outside extended base into cup 426. Activate ultra-sonic welder and form material of extended base over outer lid surface radially beyond center holes, extending base extension radially beyond lid outer diameter 430. Continue welding to firmly attach cup to lid 433. Extrude plastic around fuse 434.

Figure 5:
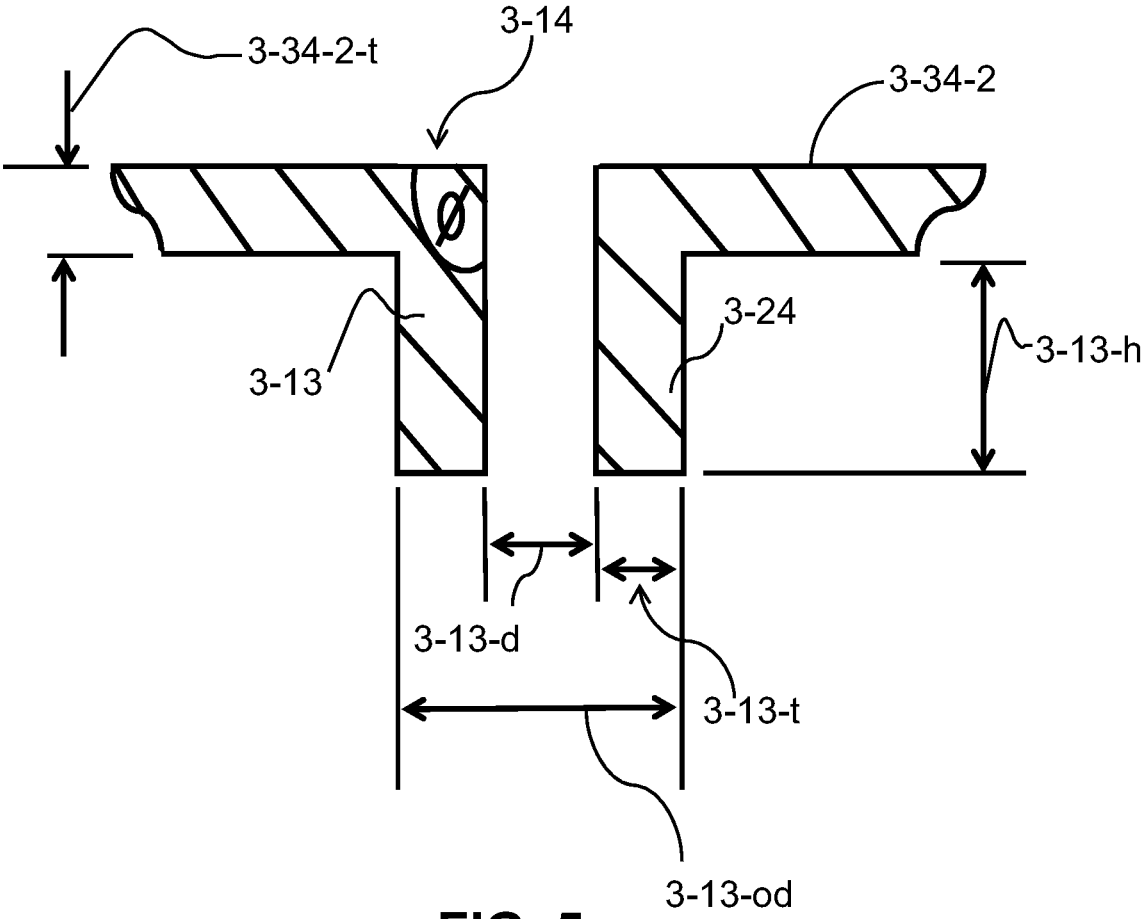
FIG. 5 shows a partial base wall and cylindrical extension of an initiator, in accordance with an exemplary embodiment of the present invention.

FIG. 5 shows a partial base wall 3-34-2 and cylindrical extension 3-24 of an initiator, in accordance with an exemplary embodiment of the present invention. The base wall 3-34-2 may have a thickness 3-34-2-*t* of between 0.03 and 0.06 inches. The cylindrical extension 3-24, or extended base 3-24, may have the same thickness 3-34-2-*t* as the base wall 3-34-2 of the cup or may have a different thickness. The cylindrical extension thickness 3-13-*t* may be between 0.03 and 0.06 inches. The cylindrical extension 3-24, shown in its extended form 3-13 may have a height between 0.10 and 0.20 inches. All dimensions are exemplary and any given cup embodiment, in accordance with the present invention, may have any or all of the exemplary dimensions. Still referring to FIG. 5, the extended base 3-24, cylindrical extension 3-24, may have an inner diameter 3-13-*d* of between 0.10 and 0.12 inches and/or an outer diameter 3-13-0D of between 0.16 and 0.24 inches in its extended form 3-13, in accordance with an exemplary embodiment of the present invention. In accordance with an exemplary embodiment of the present invention, the angle 3-14 between the integral base wall 3-34-2 and the cylindrical extension 3-23 in extended form 3-13 is ninety degrees. In accordance with an exemplary embodiment, the initiator base wall 3-34-2-*t*, FIG. 5, and the cylindrical extension 3-13-*t*, FIG. 5 wall thickness may be the same and the initiator side wall 3-34-1, FIG. 3A may also have the same thickness. In alternate embodiments, any two of base wall, side wall, and cylindrical extension are equal. In still another exemplary embodiment, no two have the same thickness.

In accordance with an exemplary embodiment of the present invention, the cup and cylindrical extension are integral and may be made using a thermoform process, such as injection molding. During attachment of the initiator cup 3-34 to the container lid 20, the cylindrical extension 3-24 may be formed 3-13-A to a dimension larger than the diameter of the lid hole, in accordance with exemplary embodiments of the present invention, as shown in FIG. 3B. This process can provide a stable attachment of the cup 3-34 to the lid 20. Further, this thermoform process may seal the holes of the cup and container, preventing fire suppressant powder from leaking from the container. In turn, the fiber washer 140 of the conventional initiator, as shown in FIG. 1B for example, may be eliminated and is eliminated in accordance with an exemplary embodiment of the present invention. In accordance with embodiments of the present invention, the terminal 93 with its shield 94 and rivet 97, also shown in FIG. 1B, is omitted. This elimination of fiber washer and terminal reduces the parts needed to form an initiator.

The present invention provides a novel method of attaching an initiator cup to a fire suppressor container. Exemplary embodiments of the present invention incorporate a novel approach to securing the fuse to the initiator. The effective fuse retention, in accordance with exemplary embodiments of the present invention does not require the conventional application of lacquer to secure the fuse and seal the container 295, described for example in relation to FIG. 2. The elimination of the need for lacquer and its application may further improve the manufacturing process by, for example, reducing costs, manufacturing time, and labor. The mechanical sealing of the container and securing of the fuse with the thermoforming of the cylindrical extension into attachment form may improve long term fuse retention in the initiator and the associated fire suppressor. The mechanical thermoform attachment may be more robust than the terminal and lacquer container closure and fuse attachment method.

In accordance with the present invention, the fuse can be inserted into the cylindrical extension and the initiator-fuse assembly can be thermoformed to firmly attach the cup to the lid and secure the fuse to the cup as shown in FIG. 3B. Thermoforming the cylindrical extension will extrude plastic material around the fuse. Such method for may provide a more robust securing of the fuse to the initiator and may provide improved fuse retention over conventional methods. Further, the plastic extrusion can contribute to tamper-proofing the stovetop fire suppressor.

Embodiments of the present invention may include a fuse diameter larger than in internal cylindrical extension diameter. This may provide a twofold advantage, yielding an increase in exposed area to a stovetop flame contributing to securing of the fuse to the cup. Use of a rough surfaced fuse, in accordance with an exemplary embodiment of the present invention may also yield a more robust attachment of the fuse to the initiator cup. For example, an inadvertent tug on the fuse may have no effect on the activation integrity of the device due to an improved mechanical adhesion, or grip, of the cup on the fuse created by the rough or gritty fuse outer surface. In accordance with an exemplary embodiment of the present invention, the fuse employed is lacking a metallic member. This non-metallic fuse will provide flame activation while eliminating heat or electric charge activation of the fire suppressor.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended drawings.

What is claimed is:

1. A method of making an initiator for an automatic stovetop fire suppressor, the method comprising:

forming a single unitary piece initiator cup via injection molding, the single unitary piece initiator cup comprising:

a sidewall and a base wall, wherein the sidewall is integral to the base wall;

an outwardly directed cylindrical extension integrated with the base wall and centered in the base wall;

a center opening in the outwardly directed cylindrical extension; and an outer diameter of the outwardly directed cylindrical extension sized to matingly fit in a hole of a fire suppression container lid.

2. The method according to claim 1, further comprising:

placing the single unitary piece initiator cup on a lower nest in an ultra-sonic welder with the cylindrical extension facing up; and positioning a fire suppressor container lid above the cup with an inside of the container lid facing down.

3. The method according to claim 1, further comprising:

aligning the hole in the container lid with the outer diameter of the cylindrical extension.

4. The method according to claim 3, further comprising:

lowering the container lid over the cylindrical extension of the cup.

5. The method according to claim 4, further comprising:

acquiring a fuse of desired length; and inserting the acquired fuse from an outside of the cylindrical extension into an inside of the cup.

6. The method according to claim 5, further comprising:

activating the ultra-sonic welder;

forming material of the cylindrical extension over an outer container lid surface radially outward; and extending the forming cylindrical extension radially beyond an outer diameter of the centered hole in the container lid.

7. The method according to claim 6, further comprising:

further welding; and firmly attaching the initiator cup to the container lid.

8. The method according to claim 7, further comprising: extruding plastic around the inserted fuse.

9. The method according to claim 5, further comprising: using a fuse with a rough outer surface.

10. The method according to claim 5, further comprising: using a fuse lacking a metallic component.

11. The method according to claim 5, further comprising: using a fuse with an outer diameter of at least 0.11 inches.

* * * * *